US009764182B2

(12) United States Patent
Rohanna

(10) Patent No.: US 9,764,182 B2
(45) Date of Patent: Sep. 19, 2017

(54) FREE WEIGHT WITH RIDGED GRIP

(71) Applicant: Daniel Joseph Rohanna, New York, NY (US)

(72) Inventor: Daniel Joseph Rohanna, New York, NY (US)

( * ) Notice: Subject to any disclaimer, the term of this patent is extended or adjusted under 35 U.S.C. 154(b) by 361 days.

(21) Appl. No.: 14/289,288

(22) Filed: May 28, 2014

(65) Prior Publication Data

US 2015/0343260 A1 Dec. 3, 2015

(51) Int. Cl.

| | |
|---|---|
| ***A63B 21/00*** | (2006.01) |
| ***A63B 21/072*** | (2006.01) |
| ***A63B 23/16*** | (2006.01) |
| *A63B 23/14* | (2006.01) |

(52) U.S. Cl.

CPC ..... *A63B 21/0726* (2013.01); *A63B 21/072* (2013.01); *A63B 23/16* (2013.01); *A63B 23/14* (2013.01)

(58) Field of Classification Search

CPC ..... A63B 21/00
USPC ..... 482/49, 132
See application file for complete search history.

(56) References Cited

U.S. PATENT DOCUMENTS

| | | | | |
|---|---|---|---|---|
| D197,899 | S | 4/1964 | Sutcliffe | |
| 3,622,152 | A * | 11/1971 | Place | A63B 23/16 482/132 |
| 4,538,806 | A | 9/1985 | Wilkerson | |
| 4,712,792 | A | 12/1987 | Rogall | |
| D297,751 | S | 9/1988 | Brown | |
| 5,823,922 | A | 10/1998 | Eckmann | |
| D456,705 | S | 5/2002 | Vijn | |
| 7,494,452 | B2 | 2/2009 | Kemery et al. | |
| 7,588,519 | B2 | 9/2009 | McClusky | |
| 2010/0222186 | A1 | 9/2010 | Grand | |
| 2011/0009247 | A1 | 1/2011 | Januszek | |
| 2011/0230317 | A9 | 9/2011 | Barber | |

* cited by examiner

*Primary Examiner* — Jerome W Donnelly
(74) *Attorney, Agent, or Firm* — Seth Natter; Natter & Natter

(57) ABSTRACT

A free weight which has a ridge on the top of the weight for a user to grip is provided. The ridge may at least partially surround the top end and/or bottom end of the free weight. In certain embodiments, the ridge may completely surround the top end and/or bottom end of free weight. The user may grasp the weight by wrapping their fingertips around the ridge and perform reps to strengthen the grip and arms of the user.

19 Claims, 8 Drawing Sheets

FIG.6
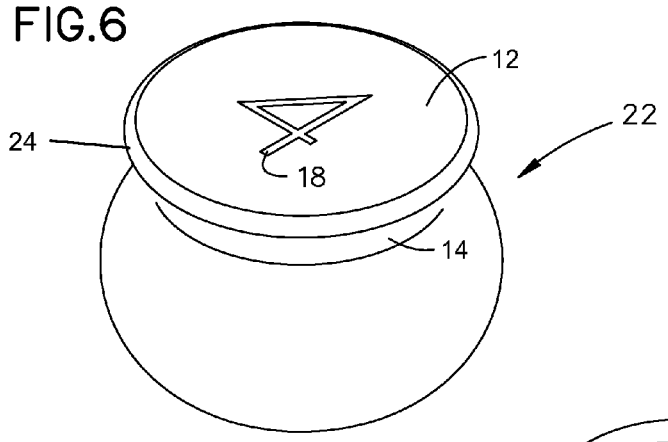
FIG.7
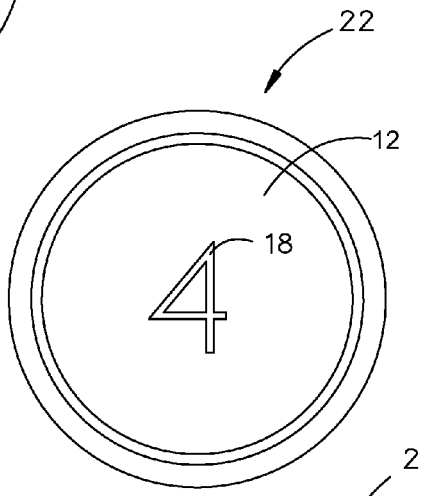
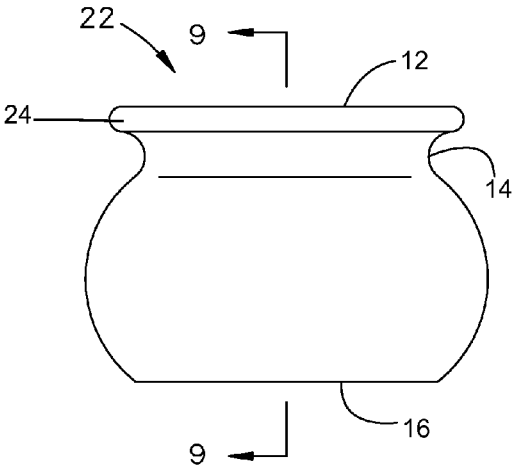
FIG.8
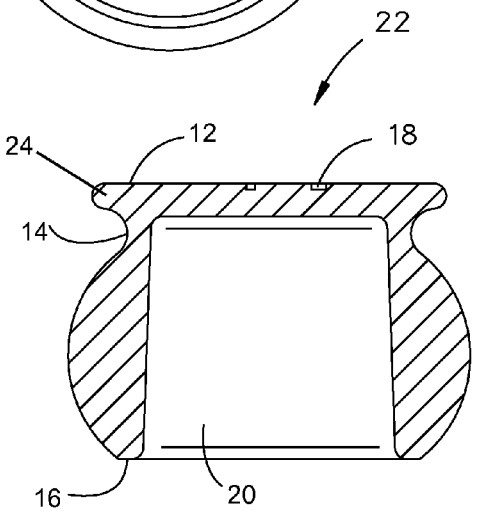
FIG.9

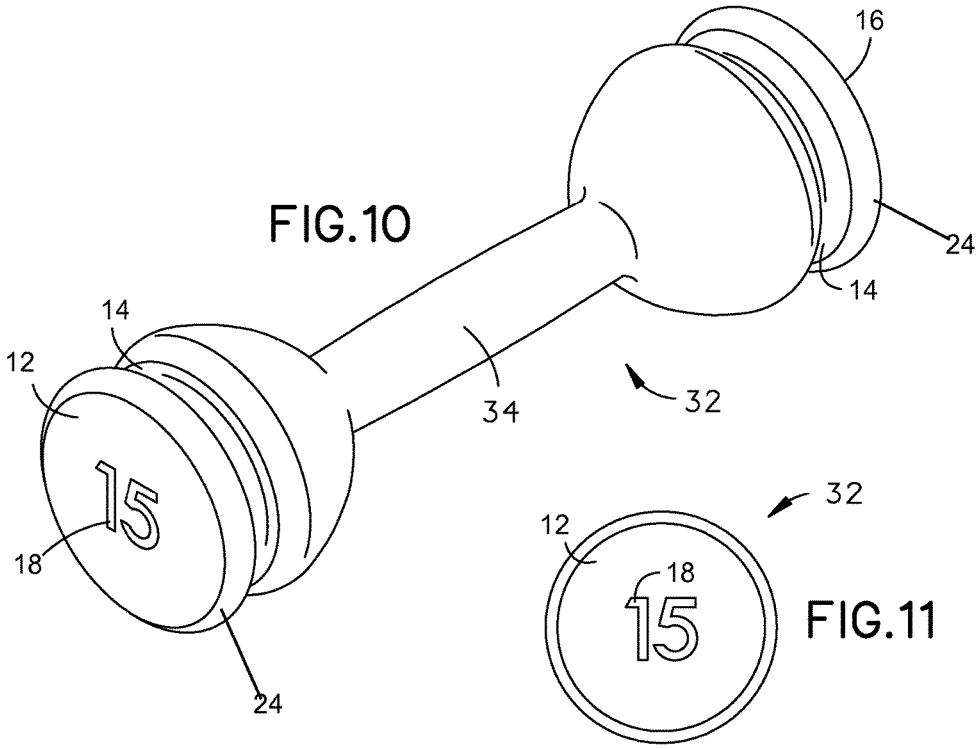
FIG.10
FIG.11
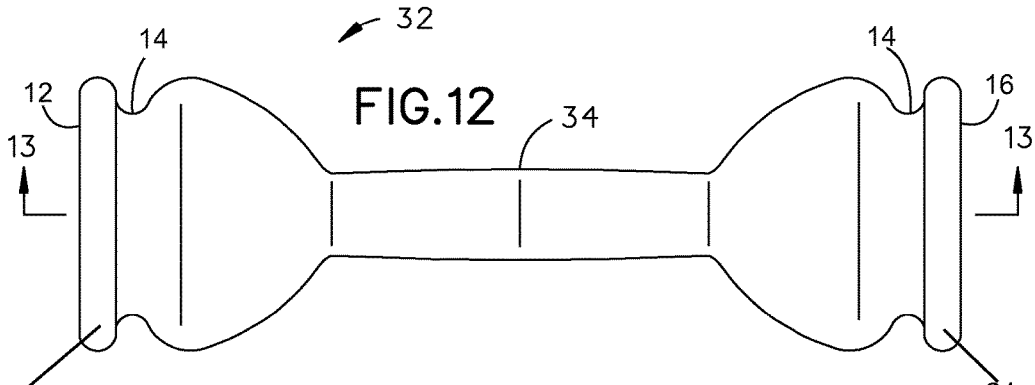
FIG.12
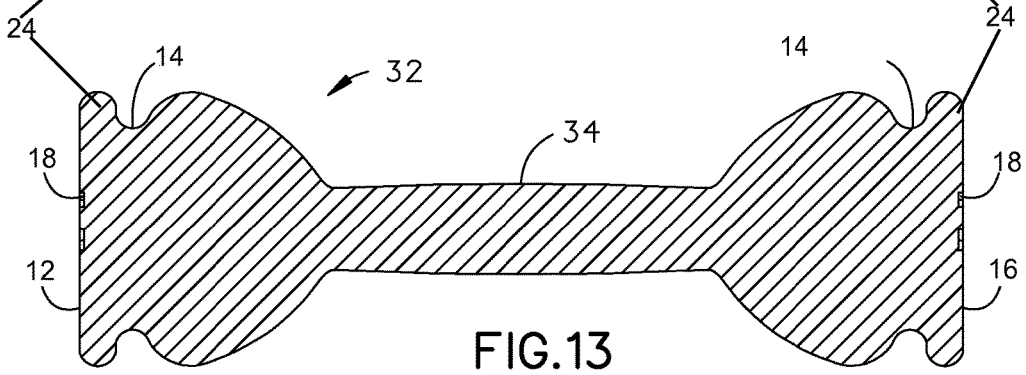
FIG.13

FIG.32
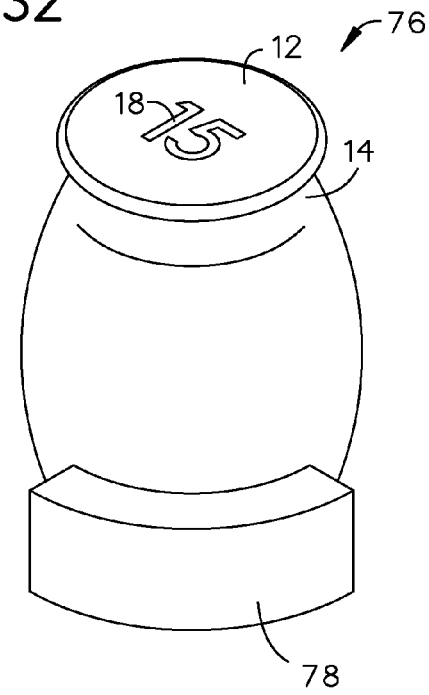
FIG.33
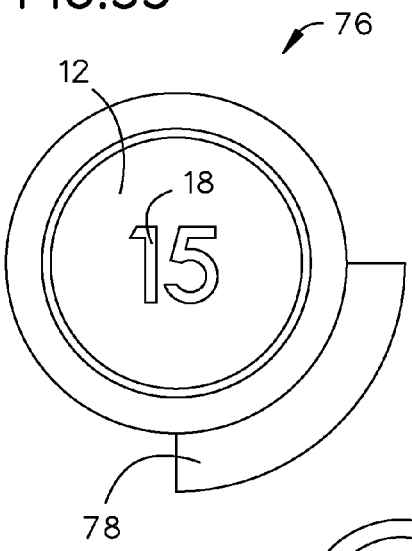
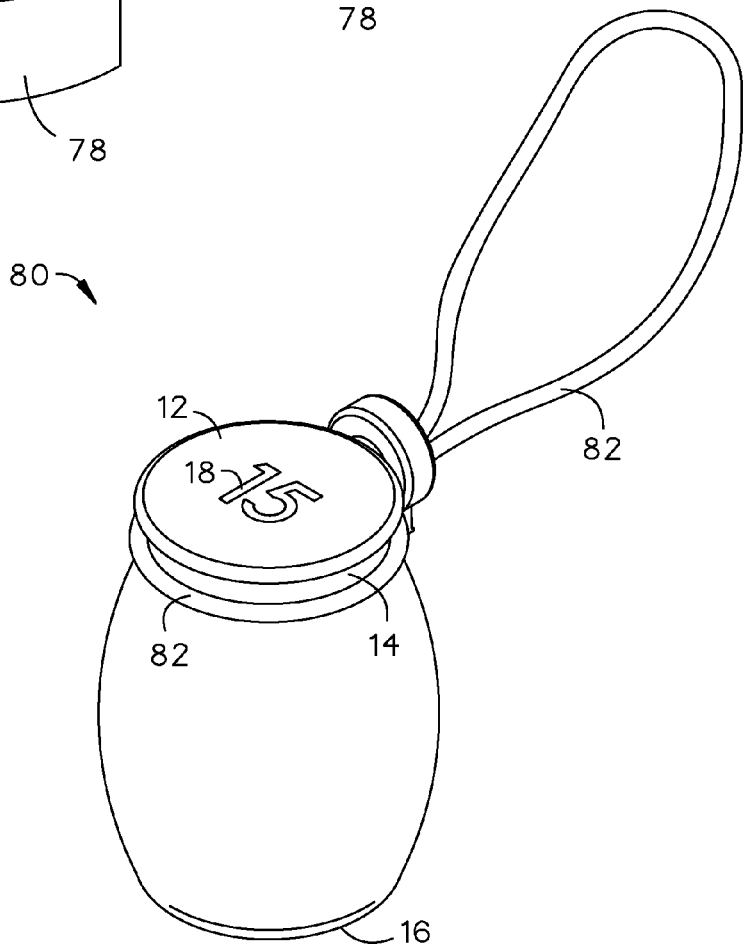
FIG.34

FREE WEIGHT WITH RIDGED GRIP

BACKGROUND OF THE INVENTION

The present invention relates to a free weight and, more particularly, to a free weight with a ridged grip.

In general, a person may experience a weak grip strength, weak wrists, carpel tunnel syndrome and other issues. Further a person may want to strengthen their wrists, forearms and grip. Currently, there are insufficient free weights and devices that strengthen a user's grip as well as the user's forearm and wrists.

As can be seen, there is a need for free weight which can be used to strengthen ones wrists, forearms and grip.

SUMMARY OF THE INVENTION

In one aspect of the present invention, a free weight comprises: a body comprising a top end, a bottom end, and a sidewall; a ridge laterally protruding from at least a portion of at least one of the top end and the bottom end, wherein the ridge forms a channel in between the sidewall and the at least one of the top end and the bottom end, wherein the channel is sized to receive fingers of a user's grip.

In another aspect of the present invention, a method of strengthening a user's grip comprises: providing a free weight comprising a body portion having a top end and a bottom end, wherein at least one of the top end and the bottom end comprises a ridge; gripping the ridge of the free weight with the user's fingertips; and lifting the free weight with the fingertips.

These and other features, aspects and advantages of the present invention will become better understood with reference to the following drawings, description and claims.

BRIEF DESCRIPTION OF THE DRAWINGS

FIG. 6 is a top perspective view of an alternate embodiment of the present invention;

FIG. 7 is a top view of an alternate embodiment of the present invention;

FIG. 8 is a front view of an alternate embodiment of the present invention;

FIG. 9 is a section view, taken along line 9-9 in FIG. 8 of an alternate embodiment of the present invention;

FIG. 10 is a perspective view of an alternate embodiment illustrating a dumbbell;

FIG. 11 is a side view of an alternate embodiment of the present invention;

FIG. 12 is a front view of an alternate embodiment of the present invention;

FIG. 13 is a section view, taken along line 13-13 in FIG. 12 of an alternate embodiment of the present invention;

FIG. 32 is a perspective view of an alternate embodiment of the present invention;

FIG. 33 is a top view of FIG. 32; and

FIG. 34 is a perspective view of an alternate embodiment of the present invention.

DETAILED DESCRIPTION OF THE INVENTION

Figure 1:
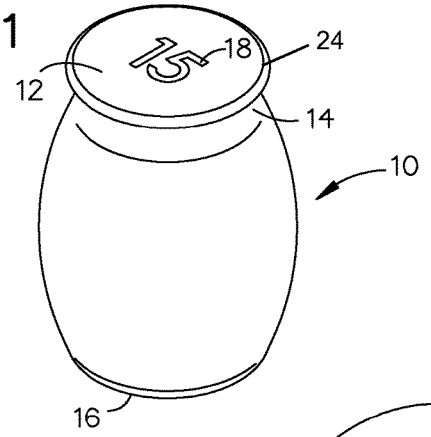
FIG. 1 is a top perspective view of the present invention.
Figure 2:
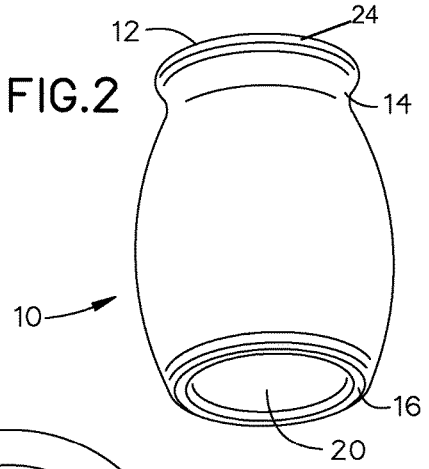
FIG. 2 is a bottom perspective view of the present invention.
Figure 3:
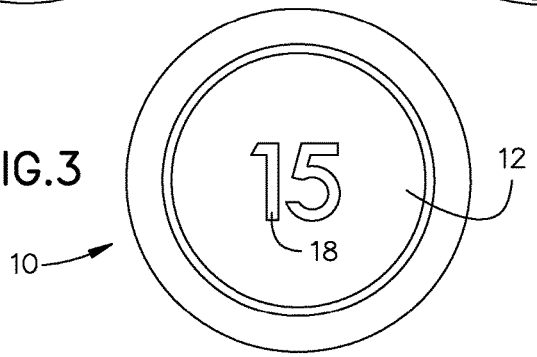
FIG. 3 is a top view of the present invention.
Figure 4:
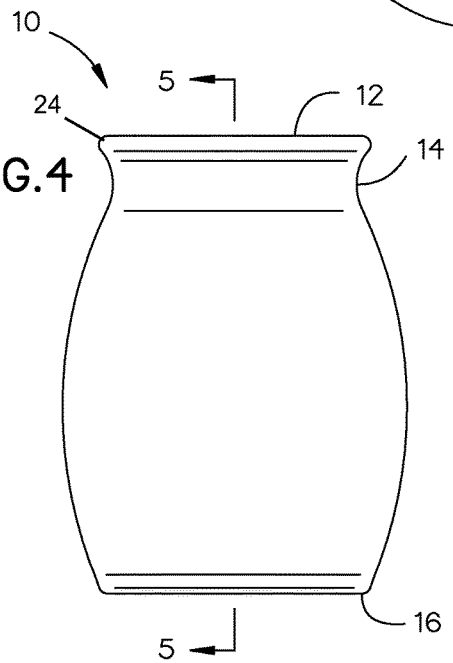
FIG. 4 is a front view of the present invention.
Figure 5:
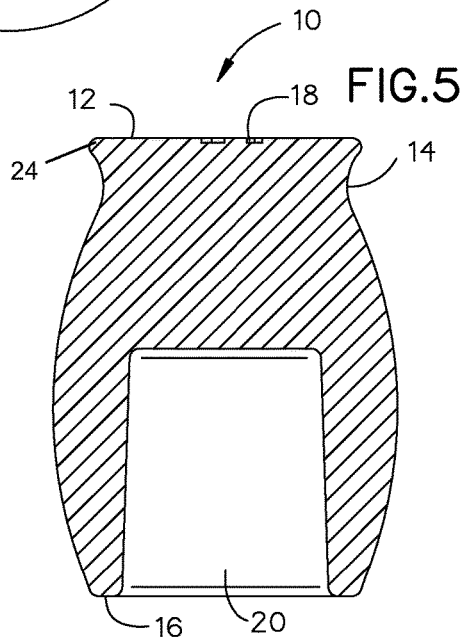
FIG. 5 is a section view, taken along line 5-5 in FIG. 4 of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another, in combination, or combination with other features.

In certain embodiments, the free weight of the present invention may include any weight which has a ridge on the top of the weight for a user to grip. The ridge may at least partially surround the top of the free weight or completely surround the top of free weight. The free weight of the present invention may be made of any appropriate material, such as, but not limited to, metal, wood, dense polymers and the like.

The free weight may be in any shape conducive to exercising. For example, the free weight may be a circular shape, cubed shape, triangular shape, teardrop shape, jar shape and the like. The free weight may be made of metal, a wood, a polymer such as plastic or rubber, or combination thereof. The free weight may be made in a range of weight levels. The size of the weight can vary greatly, depending on the desire of an individual user. The ridge type grip may also be added to a known weight device, including, but not limited to, a dumbbell, sandbag, the bottom of a kettle bell, medicine ball, or any weight device in which the grip may be utilized.

In certain embodiments, the ridged grip disclosed herein may encompass a modified dumbbell grip that allows the dumbbell to be used for multiple exercises. Due to the bell portion of the weight having an ergonomic ridge, the ridged grip allows an individual to utilize the dumbbell for an assortment of different exercises when compared to a traditional dumbbell. The ridged grip modification allows athletes to take advantage of a range of exercises and conditioning that are not currently achievable given the limited design of the free weights found in the majority of fitness centers and gyms.

The ridged grip may be used in a downward palm grasp which, when engaged in gripping the weight, strengthens muscles in the hands, arms and shoulders. The ridged grip may be used for a side or barrel grip. The side or barrel grip is similar to holding a soda can, with the index finger and the thumb fitting around the ridge and neck of the weight. The ridged grip may also be used as a neutral grip which is similar to the barrel grip, however the weight is on its side and the hand is underneath the weight.

The use of the ridged grip allows for specialized training that is beneficial to athletes, including but not limited to, martial artists, hockey, football, and basketball players seeking to maximize their grip strength for competition. In addition, there are significant therapeutic benefits to regular use for many common issues such as repetitive stress injuries. In certain embodiments, the modification of the dumbbell is of the bell portion of the weight, thus the free weight may be used for the same range of traditional weight training exercises as existing dumbbells and may be manufactured in a range of weight levels.

Referring to FIG. 1 through 34, the present invention includes a free weight 10. The free weight 10 may include a body having a top end 12, a bottom end 16, and a sidewall. The free weight 10 may further include a ridge 24 laterally protruding from at least a portion of the top end 12 and/or the bottom end 16. A channel 14 sized to receive fingers of a user's grip may be formed between the top end 12 and/or bottom end 16 and the sidewall due to the ridge 24.

As mentioned above, the ridge 24 may be sized so that a user may grasp the free weight 10 by the tips of their fingers. Therefore, the channel 14 may be sized slightly larger than a user's finger tips so that a user may firmly grasp the free weight 10 with their finger tips. In certain embodiments, the ridge 24 is laterally protruding from a substantial portion of the top end 12 and/or the bottom end 16. In certain embodiments, the ridge 24 is laterally protruding from the entire portion of the top end 12 and/or the bottom end 16.

Referring to FIGS. 1 through 9, the free weight 10 of the present invention may be shaped as a jar bell 22. In such embodiments, the ridge 24 of the present invention may be protruding laterally from the top end 12 of the jar bell 22. In certain embodiments, the jar bell 22 may include a weight indicator 18 on the top surface of the top end 12. In certain embodiments, the jar bell 22 may further include a bottom end 16 that forms an opening leading into a draft in cavity 20.

Referring to FIGS. 10 through 13, the free weight 10 of the present invention may be shaped as a dumbbell 32. In such embodiments, the dumbbell 32 may include a handle 34 for normal dumbbell use. The handle 34 may separate the top end 12 and the bottom end 16. Each of the top end 12 and the bottom end 16 may include the ridge 24 laterally protruding so that the user may grasp the dumbbell 32 with the user's fingertips to work out the user's grip. The dumbbell 32 may also include a weight indicator 18 on the surface of the top end 12 and the bottom end 16.

Figure 14:
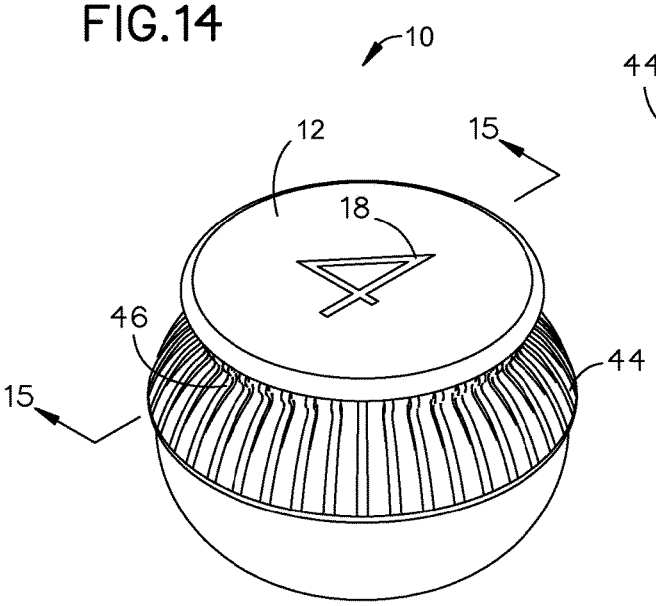
FIG. 14 is a perspective view of an alternate embodiment of the present invention.
Figure 15:
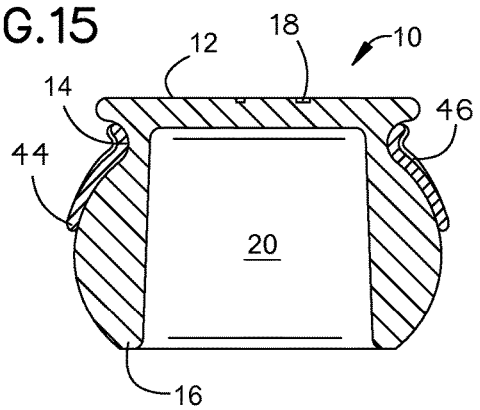
FIG. 15 is a section view, taken along line 15-15 in FIG. 14.
Figure 16:
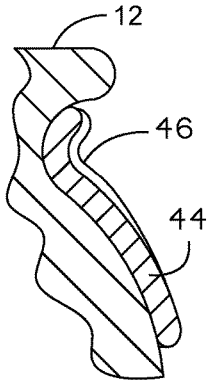
FIG. 16 is a detailed section view of FIG. 15, illustrating the grip ridges.

Referring to FIGS. 14 and 15, the present invention may include a compressible covering 44. The compressible covering 44 may be made out of a polymer, such as rubber. The compressible covering 44 may fit over the free weight 10, within the channel 14 and may be positioned below the ridge 24. The compressible covering 44 may form a compressible channel 46 within the channel 14 of the free weight 10. Therefore, a user may easily grip the ridge 24 with their fingertips, and the compressible covering 44 may provide comfort and additional gripping.

Figure 17:
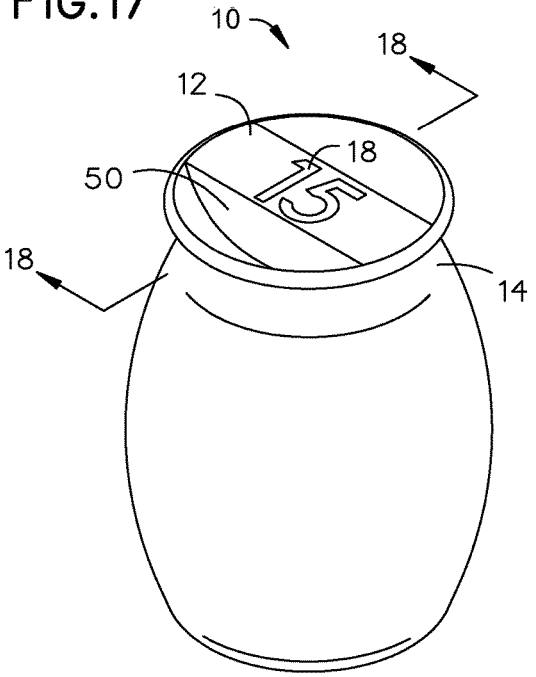
FIG. 17 is a perspective view of an alternate embodiment of the present invention.
Figure 18:
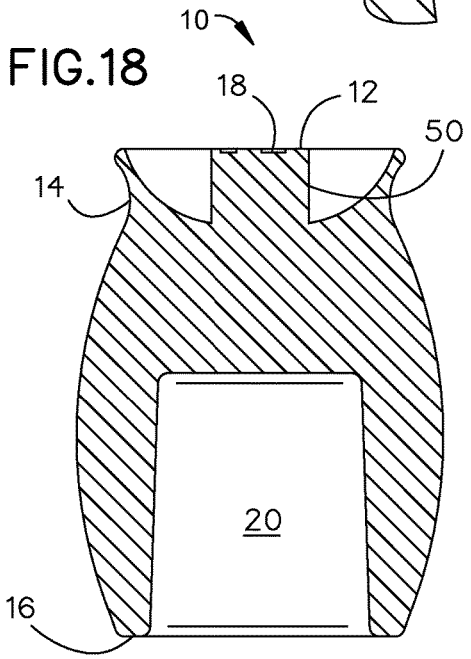
FIG. 18 is a section view, taken along line 18-18 in FIG. 17.

Referring to FIGS. 17 and 18, the present invention may further include a pinch grip 50. The top surface of the top end 12 of the free weight 10 may include recessed portions forming the protruding pinch grip 50 in between. In certain embodiments, users may grasp the pinch grip 50 with their fingertips and perform different exercises.

Figure 19:
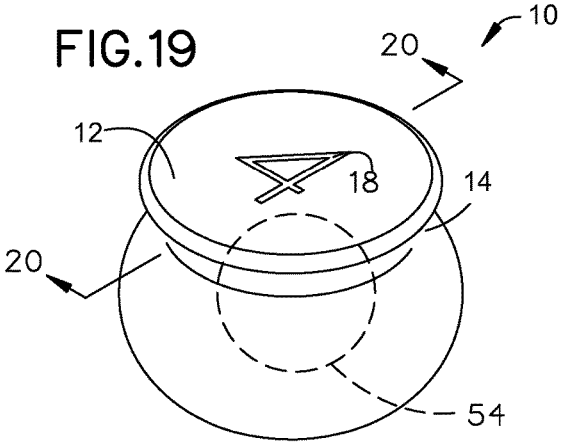
FIG. 19 is a perspective view of an alternate embodiment of the present invention.
Figure 20:
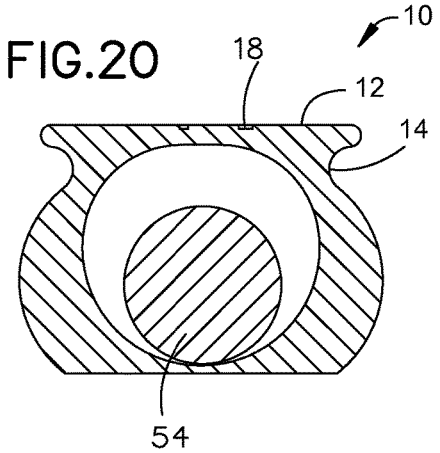
FIG. 20 is a section view, taken along line 20-20 in FIG. 19.

Referring to FIGS. 19 and 20, the free weight 10 of the present invention may include an enclosed internal cavity. The enclosed internal cavity may contain a liquid, sand and the like, adding a shifting weight distribution. Alternatively, the enclosed internal cavity may include a ball weight 54. The ball weight 54 may shift within the enclosed internal cavity, providing exercise to different muscle groups within the hand, wrist and forearm.

Figure 21:
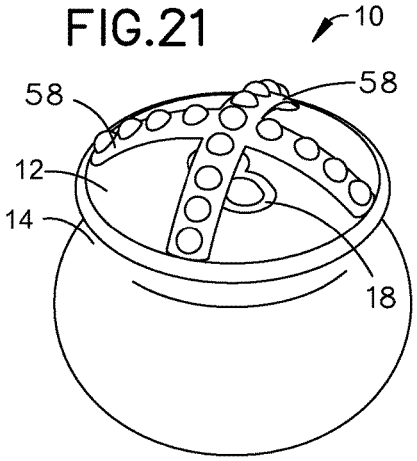
FIG. 21 is a perspective view of an alternate embodiment of the present invention.
Figure 22:
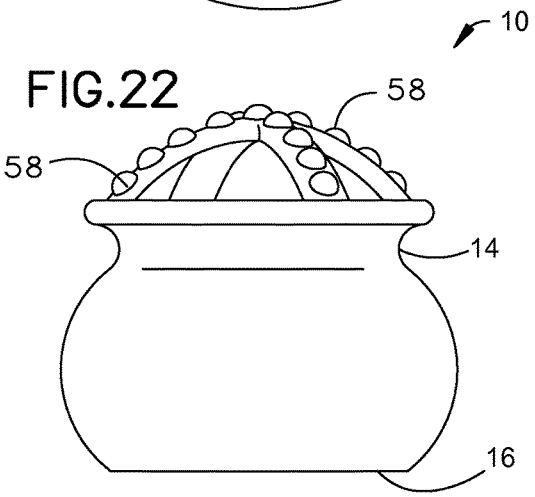
FIG. 22 is a front view of FIG. 21.
Figure 23:
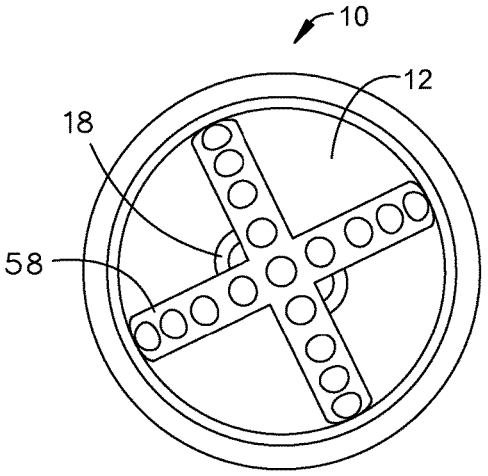
FIG. 23 is top view of FIG. 21.

Referring to FIGS. 21 through 23, the present invention may further include handles 58. The handles 58 may be connected to and protrude from the top end 12 of the free weight 10. In certain embodiments, the handles 58 may crisscross one another. The handles 58 may be used for easily transporting the fee weights 10, or alternatively for additional exercises.

Figure 24:
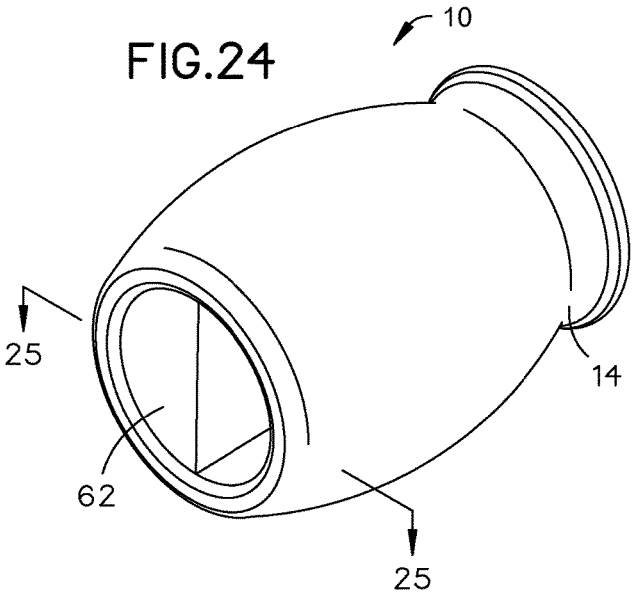
FIG. 24 is a bottom perspective view of an alternate embodiment of the present invention, illustrating an internal magnetic weight.
Figure 25:
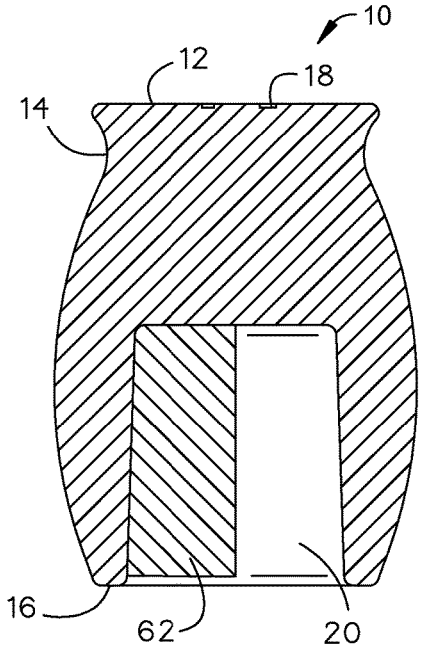
FIG. 25 is a section view, taken along line 25-25 in FIG. 24.
Figure 26:
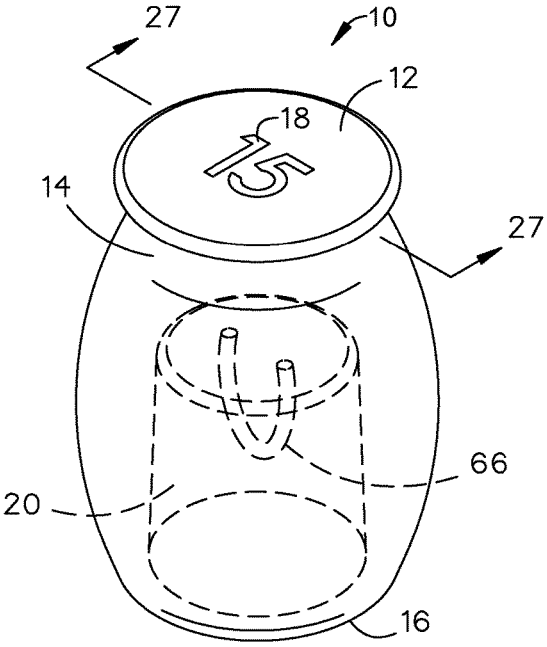
FIG. 26 is a perspective view of an alternate embodiment of the present invention.
Figure 27:
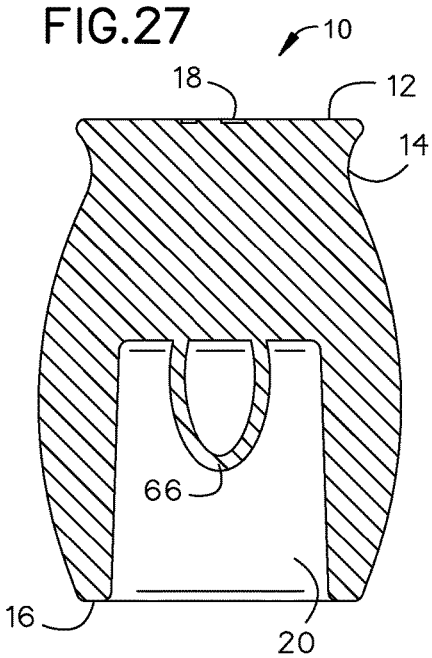
FIG. 27 is a section view, taken along line 27-27 in FIG. 26.

In certain embodiments, the draft in cavity 20 may be used with different components. Referring to FIGS. 24 and 25, magnetic weights 62 may be used within the cavity 20. Therefore, a user may easily add and subtract weight to the free weight 10. Referring to FIGS. 26 and 27, a hook 66 may be attached to the free weight 10 within the cavity 20. Therefore, different weights and chains may be hooked to the hook 66 and thereby attached to the free weight 10.

Figure 28:
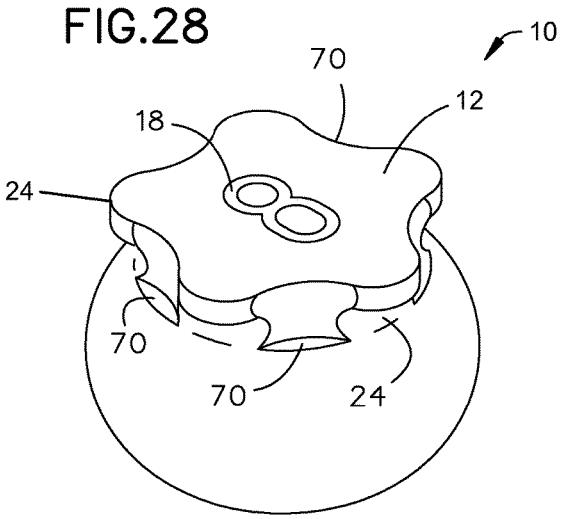
FIG. 28 is a perspective view of an alternate embodiment of the present invention.
Figure 29:
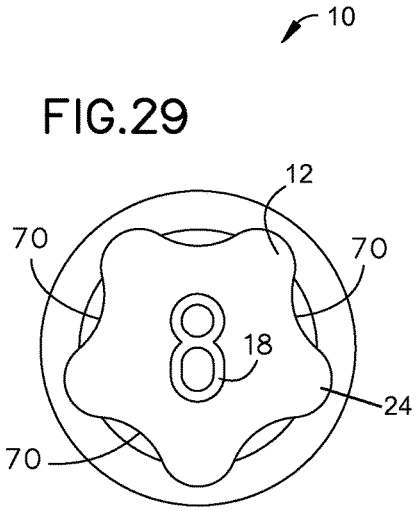
FIG. 29 is a top view of FIG. 28.
Figure 30:
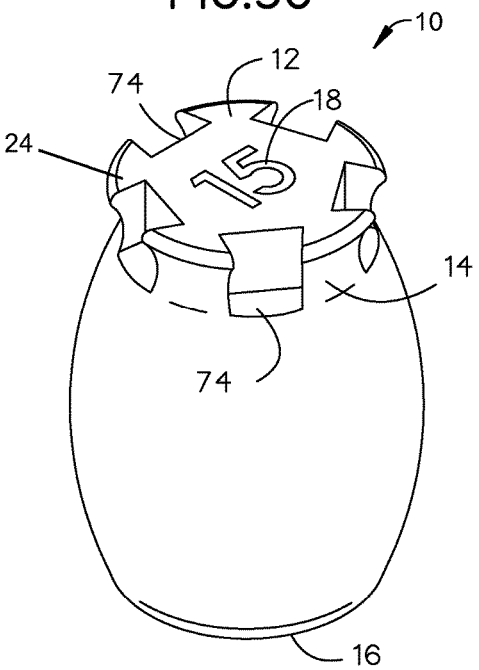
FIG. 30 is a perspective view of an alternate embodiment of the present invention.
Figure 31:
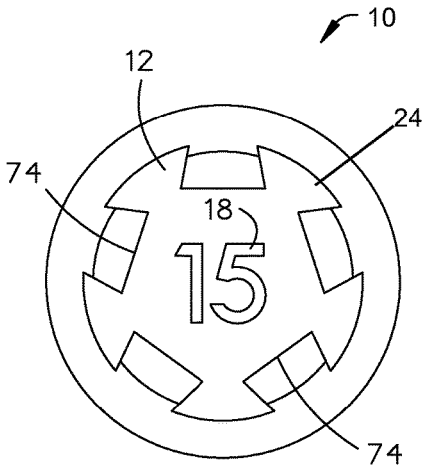
FIG. 31 is a top view of FIG. 30.

In certain embodiments, the ridge 24 of the present invention may include different designs for different uses. Referring to FIGS. 28 and 29, the ridge 24 may include curved finger holes 70 along the perimeter. The curved finger holes 70 allow users to easily grip the ridge 24. Referring to FIGS. 30 and 31, the present invention may further include bracket shaped finger holes 72 for alternative grips.

In certain embodiments, the present invention may further include external add-ons. For example, as illustrated in FIGS. 32 and 33, the present invention may include external magnets 78 that attach to the outside surface of the free weights 10. As illustrated in FIG. 34, the present invention may further include removable leashes 82 that may be secured around the ridge 24 and within the channel 14 of the free weight.

A method of strengthening a user's grip may include the following. First, the free weight having the ridge mentioned above is provided. The user may then grasp the ridge of the free weight so that the fingertips are within the channel formed. The user may then lift the free weight and perform reps to strengthen their grip and other arm and hand muscles.

The modified dumbbell grip allows a weight to be used for more than traditional exercises. By altering the bell portion of a weight to accommodate an ergonomic ridge and repositioning the distribution of weight to be center focused through the palm of the hand, the present invention allows an individual to utilize the weight for many more training exercises than traditional weights. This simple modification allows athletes to take advantage of a range of exercises and conditioning that are not currently possible given the limited design of the free weights found in the majority of fitness centers and gyms. The present invention may be used in the following ways: with a downward palm grasp, and a side grip (thumb-toward-the-sky). When engaged in gripping the weight, the muscles in the hands, wrist, elbows, and shoulders are strengthened. This style of grip creates a stronger kinematic connection traveling from the fingertips up through the wrist, elbow, and shoulder. Use of the present invention allows for specialized training that is particularly beneficial to elite athletes, including but not limited to, martial artists, tennis, lacrosse, hockey, wrestling, football, golf, and baseball players seeking to maximize their over-all competitive training. The use of the present invention in a targeted and on-going basis can result in significant therapeutic benefits for many common issues including Carpal Tunnel Syndrome (CTS) and repetitive stress injuries. By correcting postural dysfunction at each joint of the hand, wrist, elbow, and shoulder, the functional strength and coordination of the upper extremities may be significantly improved.

It should be understood, of course, that the foregoing relates to exemplary embodiments of the invention and that modifications may be made without departing from the spirit and scope of the invention as set forth in the following claims.

What is claimed is:

1. A free weight comprising: a body comprising a top end, a bottom end, and a sidewall; a ridge laterally protruding from at least an end surface of at least one of the top end and the bottom end, the sidewall being indented adjacent the ridge to form a channel between the sidewall and the ridge, wherein the channel is sized to receive fingers of a user's grip and the end surface comprises a pinch grip.

2. The free weight of claim 1, wherein the ridge is laterally protruding from a substantial portion of the end surface of at least one of the top end and the bottom end.

3. The free weight of claim 2, wherein the ridge is laterally protruding from the entire end surface of at least one of the top end and the bottom end.

4. The free weight of claim 1, wherein the free weight is a jar bell weight.

5. The free weight of claim 1, wherein the top end of the body of the jar bell weight comprises the end surface, and the bottom end forms on opening leading to a draft in cavity.

6. The free weight of claim 5, further comprising a hook attached to the free weight within the draft in cavity.

7. The free weight of claim 1, wherein the free weight is a dumbbell weight, wherein the body comprises a handle in between the top end and the bottom end, wherein the top end and the bottom end each comprise the ridge laterally protruding from at least a portion the top end and the bottom end.

8. The free weight of claim 7, wherein the ridge is laterally protruding from the entire portion of the top end and the bottom end.

9. The free weight of claim 1 further comprising a compressible covering, the compressible covering being fitted over at least a portion of the sidewall and within at least a portion of the channel.

10. The free weight of claim 1, wherein the end surface of the top end comprises a pinch grip.

11. The free weight of claim 1, wherein the free weight is hollow forming an enclosed internal cavity.

12. The free weight of claim 1, further comprising a ball weight within the enclosed internal cavity.

13. The free weight of claim 1, further comprising a handle portion attached to the top end.

14. The free weight of claim 1, wherein the ridge comprises a plurality of finger grip holes.

15. The free weight of claim 1, further comprising a leash, the leash being attached to the free weight and disposed within the channel.

16. A method of strengthening a user's grip comprising: providing a free weight comprising a body portion having a top end and a bottom end, wherein at least one of the top end and the bottom end comprises a ridge; gripping the ridge of the free weight with the user's fingertips; and lifting the free weight with the fingertips.

17. A free weight comprising: metal body having a top end, a bottom end, and a sidewall; a ridge laterally protruding from at least a portion of at least one of the top end and the bottom end, the sidewall being indented adjacent the ridge to form a channel between the sidewall and the ridge, whereby the ridge comprises a pinch grip and the channel comprises a seat for the user's fingertips.

18. The free weight of claim 17, wherein the free weight is a jar bell weight, the top end of the body of the jar bell weight comprises the end surface, and the bottom end forms on opening leading to a draft in cavity, the free weight further comprising a magnetic weight, the magnetic weight being attached within the draft in cavity.

19. The free weight of claim 17, further comprising a magnetic weight, the magnetic weight being attached to the sidewall of the free weight.

* * * * *